US005472142A

United States Patent [19]

Iwanaga

[11] Patent Number: 5,472,142

[45] Date of Patent: Dec. 5, 1995

[54] ACCUMULATOR FUEL INJECTION APPARATUS

[75] Inventor: Takashi Iwanaga, Toyohashi, Japan

[73] Assignee: Nippondenso Co., Ltd., Kariya, Japan

[21] Appl. No.: 323,226

[22] Filed: Oct. 14, 1994

Related U.S. Application Data

[63] Continuation-in-part of Ser. No. 103,698, Aug. 10, 1993, abandoned.

[30] Foreign Application Priority Data

Aug. 11, 1992 [JP] Japan ..... 4-214080

[51] Int. Cl.[6] ..... F02M 45/02

[52] U.S. Cl. ..... 239/96; 239/533.4; 239/533.8

[58] Field of Search ..... 239/88–96, 533.4, 239/533.8, 585.1

[56] References Cited

U.S. PATENT DOCUMENTS

| | | | |
|---|---|---|---|
| 3,610,529 | 10/1971 | Huber | 239/533.8 X |
| 3,831,863 | 8/1974 | Fenne | 239/533.8 |
| 4,776,518 | 10/1988 | Yamamoto . | |
| 4,852,808 | 8/1989 | Yamamoto | 329/533.8 X |
| 5,125,575 | 6/1992 | Iwanaga . | |
| 5,156,132 | 10/1992 | Iwanaga . | |

FOREIGN PATENT DOCUMENTS

| | | | |
|---|---|---|---|
| 112793 | 4/1941 | Australia | 239/533.8 |
| 119894 | 9/1984 | European Pat. Off. . | |
| 234314 | 9/1987 | European Pat. Off. . | |
| 393590 | 10/1990 | European Pat. Off. . | |
| 1933489 | 3/1970 | Germany . | |
| 4027493 | 3/1991 | Germany . | |

*Primary Examiner*—Andres Kashnikow
*Assistant Examiner*—Kevin P. Weldon
*Attorney, Agent, or Firm*—Cushman, Darby & Cushman

[57] ABSTRACT

An accumulator fuel injection apparatus in which a nozzle element is divided into a first nozzle having one end side of said nozzle element and a second nozzle having the other end side of the nozzle element. The accumulator fuel injection apparatus comprises a stopper for setting a maximum movement position of the first nozzle toward the second nozzle, a second pressure control chamber communicating with a first pressure control chamber and forming a predetermined space or interval through which the first nozzle and the second nozzle are spaced away from each other under a condition that the first nozzle is arranged at the maximum movement position, and delay apparatus for delaying reduction of pressure within the first pressure control chamber due to the fact that fluid flows into a low-pressure chamber from the first pressure control chamber upon communication of the first pressure control chamber and the low-pressure chamber with each other. It is possible to easily perform operation of setting an amount of pre-lift of the nozzle needle which decides an injection rate, and operation of assembling constitutional elements thereof.

5 Claims, 8 Drawing Sheets

ACCUMULATOR FUEL INJECTION APPARATUS

This is a continuation-in-part of application Ser. No. 8/103,698, filed on Aug. 10, 1993, now abandoned.

BACKGROUND OF THE INVENTION

The present invention relates to an accumulator fuel injection apparatus and, more particularly, to a fuel injection apparatus for a diesel engine, which facilitates setting of an amount of pre-lift of a nozzle needle.

As a fuel injection apparatus for a diesel engine, an arrangement has been disclosed, for example, in U.S. Pat. No. 5,156,132, which comprises common accumulator piping called a common rail for accumulating high-pressure fuel, and an injector for injecting the fuel. A nozzle needle for opening and closing an injection bore is slidably arranged within the injector. The nozzle needle defines a back-pressure chamber for retaining fuel pressure which acts on the nozzle needle. Pressure within the back-pressure chamber is so controlled as to be switched to fuel pressure on the high-pressure side and fuel pressure on the low-pressure side by a three-way electromagnetic valve. Thus, the high-pressure fuel supplied from the accumulator piping is injected from the injection bore. In order to improve engine performance, pre-lift of a nozzle needle is so set as to achieve boot-type injection which is such an injection rate that an amount of injection at the initial time of injection is constant, the amount of injection is made substantially constant after the amount of injection rises again, and running-out of the injection is completed instantaneously.

For the conventional fuel injection apparatus for the diesel engine having an arrangement of the kind referred to above, however, the amount of pre-lift of the nozzle needle which determines or decides the initial amount of injection is decided by the uppermost portions of the group of parts which are moved together with the nozzle needle. Accordingly, there is a problem that dimensional management or administration of a plurality of parts in a longitudinal direction and an estimate of longitudinal deformation of the parts due to hydraulic pressure are extremely difficult.

SUMMARY OF THE INVENTION

It is an object of the invention to provide an accumulate fuel injection apparatus in which an amount of pre-lift in boot-type injection is set by a gap between a nozzle needle and a piston thereabove, whereby setting operability of the amount of pre-lift and assembling operability of the nozzle needle are improved.

According to the invention, there is provided an accumulator fuel injection apparatus comprising: a casing element formed therein with a guide bore; a nozzle body reciprocally guided in the guide bore; a first pressure control chamber against which a one end side of the nozzle body faces; an injection bore; a seat provided at the other end side of the nozzle body for opening and closing the injection bore; accumulator piping in which high-pressure fluid is accumulated; a low-pressure chamber; and a control valve, wherein the first pressure control chamber communicates with the accumulator piping, and the low-pressure chamber in switching by the control valve, to reciprocate the nozzle body, to thereby control the injection bore in opening and closing, and wherein the nozzle body is divided into a first nozzle having the one end side and a second nozzle having the other end side, the accumulator fuel injection apparatus further comprising: a stopper for setting a maximum-movement position of the first nozzle toward the second nozzle; a second pressure control chamber communicating in switching with the accumulator piping and the low-pressure chamber in synchronism with the first pressure control chamber, by the control valve, and for forming a predetermined interval through which the first nozzle and the second nozzle are spaced away from each other, under a condition that the first nozzle is arranged at the maximum movement position; and delay means for delaying reduction of the pressure within the first pressure control chamber due to the fact that fluid flows into the low-pressure chamber from the first pressure control chamber upon communication of the first pressure control chamber and the low-pressure chamber with each other.

Accordingly, with the accumulator fuel injection apparatus according to the invention, the nozzle body is divided into a plurality of elements, which have conventionally been united together, and the nozzle body is provided in which the maximum-movement position is set. It is possible to set the amount of pre-lift by a location between one end to the other end of the nozzle body.

Moreover, according to the invention, there is further provided an accumulator fuel injection apparatus comprising: accumulator piping accumulating therein high-pressure fuel; a first piston reciprocally guided in a guide bore formed in a lower element and having a one end side thereof which faces a first pressure control chamber; a stopper for setting a maximum movement position toward the other end side of the first piston; a second piston reciprocally guided in a guide bore formed in a spacer, and having a one end side thereof abutted against the other end of the first piston and the other end side facing a second pressure control chamber which communicates with the first pressure control chamber; a nozzle needle whose one end side faces the second pressure control chamber, the nozzle needle having a seat at the other end side of the nozzle needle; a valve casing having a guide bore for reciprocally guiding the nozzle needle, a valve seat abutted against the seat of the nozzle needle, and an injection bore; delay means for delaying reduction of pressure within the first pressure control chamber due to the fact that fluid flows into a low-pressure chamber from the first pressure control chamber upon communication of the first pressure control chamber and the low-pressure chamber with each other; and biasing means for spacing the second piston and the nozzle needle away from each other so as to form a predetermined gap between the other end side of the second piston and the one end side of the nozzle needle under a condition that the first piston is arranged at the maximum movement position.

Accordingly, with the accumulator fuel injection apparatus according to the invention, it is possible to manage or administer setting of the amount of pre-lift of the nozzle needle by the spacer and the second piston. Thus, it is possible to facilitate operation of adjustment of the amount of pre-lift and operation of maintenance and inspection.

PREFERRED EMBODIMENT OF THE INVENTION

An embodiment of the invention will hereunder be described with reference to the accompanying drawings.

Figure 1:
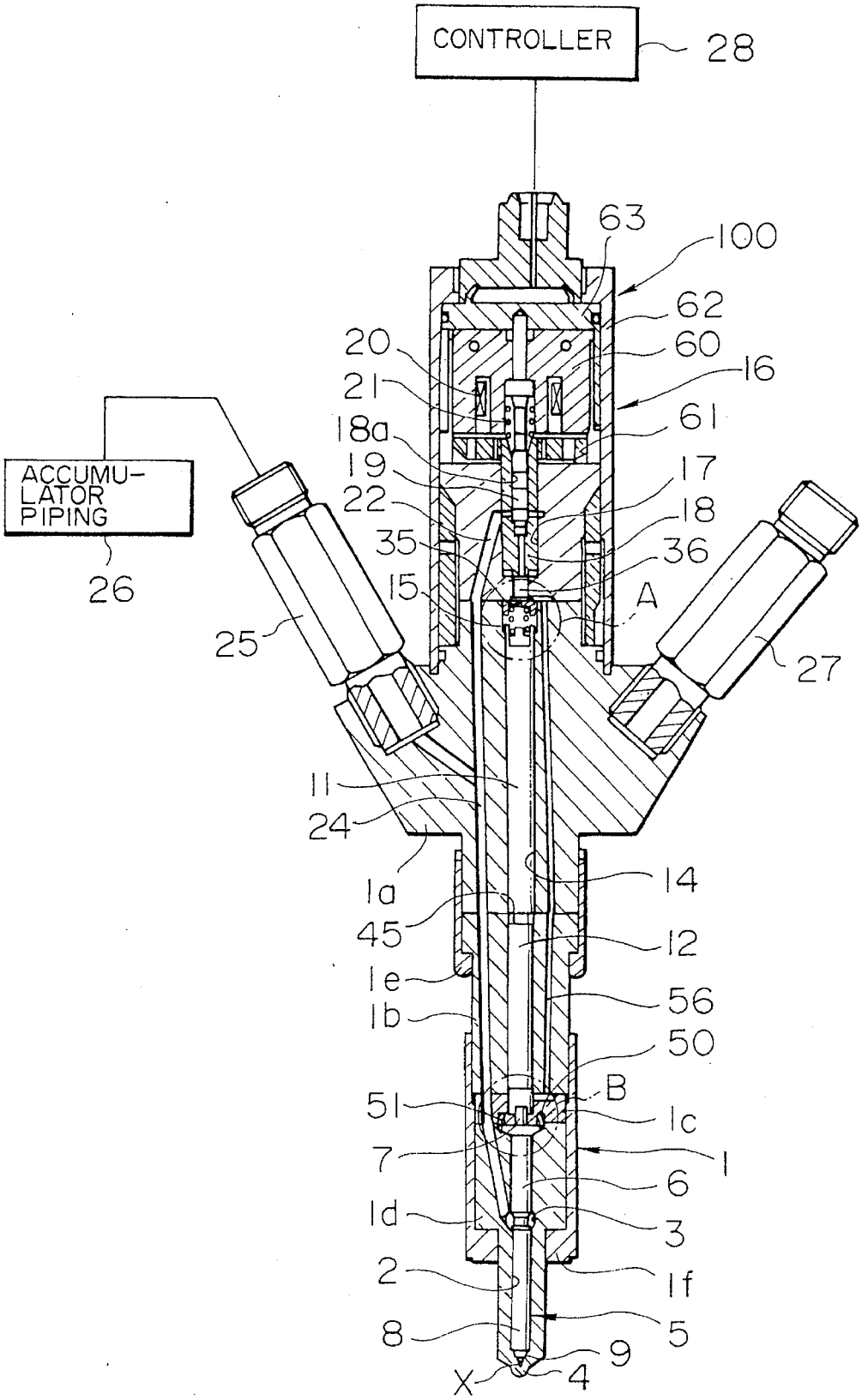
FIG. 1 is a cross-sectional view showing a fuel injection apparatus for a diesel engine, according to an embodiment of the invention.

Referring first to FIG. 1, an injector 100 has a casing 1 which comprises a lower element 1*a*, a spacer 1*b*, a distance piece 1*c* and a valve casing element 1*d*. The lower element 1*a* and the spacer 1*b* are coupled together by a first retaining ring 1*e*. The spacer 1*b*, the distance piece 1*c* and the valve casing element 1*d* are coupled together by a second retaining ring 1*f*. A valve sliding bore 2 and a fuel reservoir chamber 3 are defined in the valve casing element 1*d*. A nozzle needle 5 has a larger diameter portion 6 which is slidably fitted in the valve sliding bore 2 which communicates with the fuel reservoir chamber 3. A connecting portion 7 is formed at the larger diameter portion 6 of the nozzle needle 5. A smaller-diameter portion 8 and a valve portion 9 are integrally formed at a location below the connecting portion 7. A seat x is opened and closed by the valve portion 9 so that injection from a jetting or injection bore 4 is turned on and off.

Figure 3:
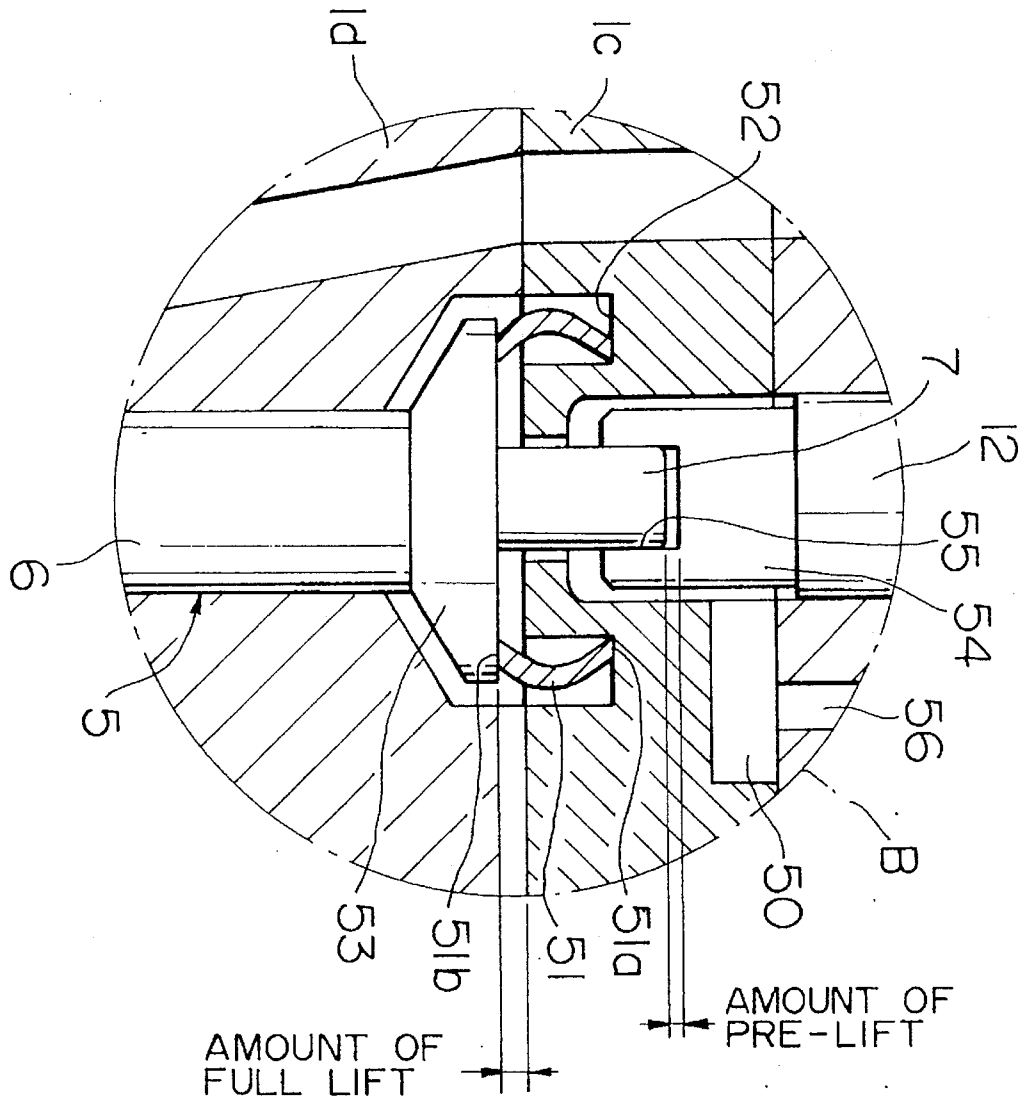
FIG. 3 is an enlarged cross-sectional view showing a portion B in FIG. 1.

A first piston 11 is slidably fitted within a cylinder 14 which is defined in the lower element 1*a*. The first piston 11 is abutted against one end of a second piston 12. The other end of the second piston 12 is formed with a smaller-diameter portion 54, as shown in FIG. 3. The connecting portion 7 of the nozzle needle 5 has a forward end thereof which is slidably fitted in a cylinder 55 formed in the smaller-diameter portion 54.

Figure 5:
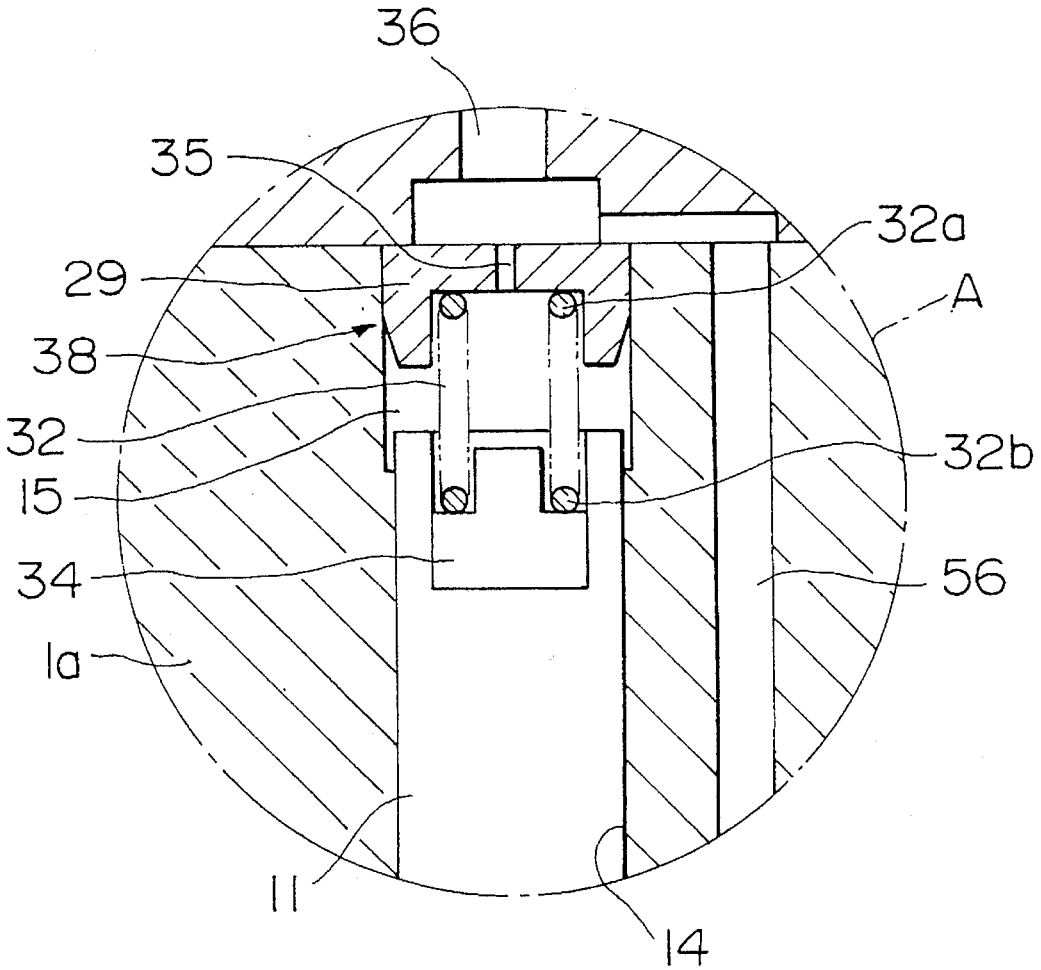
FIG. 5 is an enlarged cross-sectional view showing a portion A illustrated in FIG. 1.

A first pressure control chamber 15 is defined within the cylinder 14, as shown in FIG. 5, to form a one-way orifice 38. The first pressure control chamber 15 communicates with a passage 36 through a restriction passage 35 which is defined in a valve body 29. A compressive coil spring 32 has one end 32*a* thereof which is abutted against the valve body 29. The other end 32*b* of the compressive coil spring 32 is abutted against the first piston 11 through a valve seat 34. If high pressure is introduced to a passage 36 from a passage 22 through an inner valve 19 and an outer valve 18, the valve body 29 is depressed or is moved downwardly so that the compressive coil spring 32 and the valve body 29 are abutted against the first piston 11 to push down the first piston 11. At this time, high-pressure fuel flows into the first pressure control chamber 15 from a restriction passage 35 so that the pressure within the first pressure control chamber 15 is soon raised to high pressure. Then, when the passage 36 is switched to low pressure, the fuel flows out from the restriction passage 35 until pressure balance of the first pressure control chamber 15 is broken, to maintain the first piston 11 under a depressed condition. Subsequently, when the first pressure control chamber 15 is reduced to low pressure, pressure balance of the first pressure control chamber 15 is broken so that the first piston 11 lifts or is moved upwardly.

A second pressure control chamber 50 communicates with the passage 36 through a high-pressure fuel passage 56. As shown in FIG. 3, an annular spring element 51 is received within the second pressure control chamber 50. The annular spring element 51 has one end 51*a* thereof which is abutted against an annular groove 52 which is formed in a bottom surface of the distance piece *c*. The other end 51*b* of the annular spring element 51 is abutted against a larger-diameter spring seat 53 which is formed at a rearward end of the nozzle needle 5. The connecting portion 7 is slidable vertically within the cylinder 55 which is defined in the smaller-diameter solid cylindrical portion 54 which is formed at a rearward end of the second piston 12. Here, as shown in FIG. 3, an amount of full lift and an amount of pre-lift of the nozzle needle 5 are decided. The amount of pre-lift H is decided by a difference between the spacer 1*b* and a top of the second piston 12 illustrated in FIG. 4 upon assembling.

Figure 11:
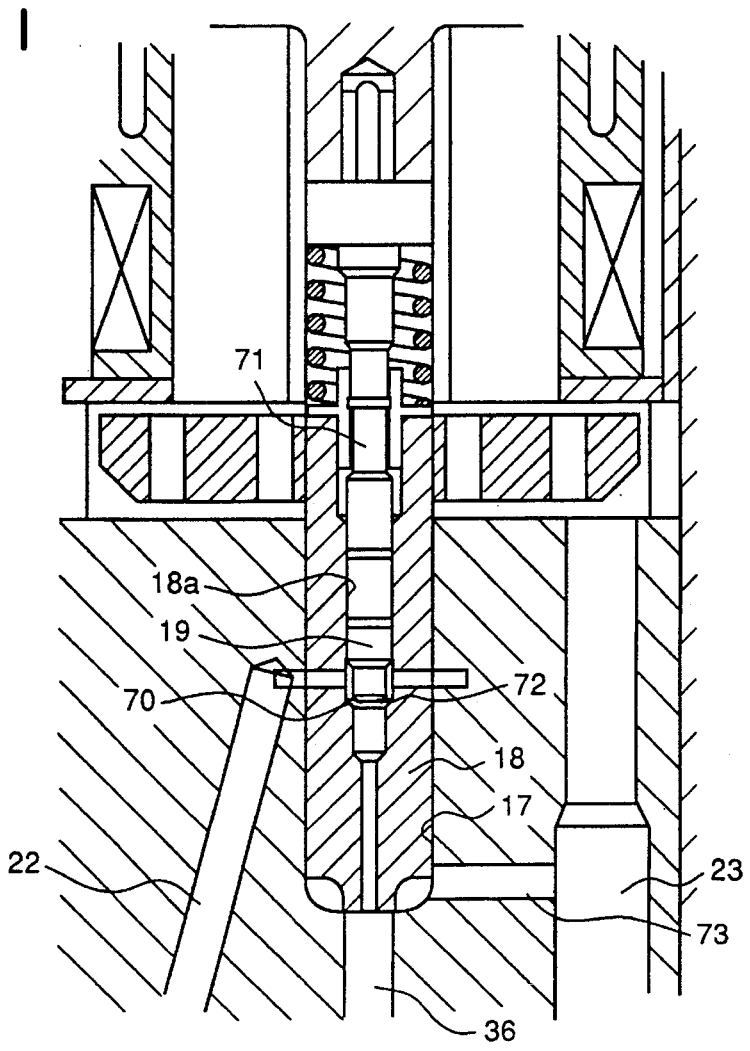
FIG. 11 is an enlarged cross-sectional view of a portion of FIG. 1 showing the three-way electromagnetic valve 16.

Referring back to FIG. 1, the three-way electromagnetic valve (control valve) 16 is arranged above the first piston 11. The three-way electromagnetic valve (control valve) 16 comprises valve means and magnetizing or exciting means. The valve means has the outer valve 18 slidably guided by a cylinder 17, and the inner valve 19 slidably guided by an internal bore 18*a* in the outer valve 18. The inner valve 19 slides in the internal bore 18*a* depending on the fuel pressure from the passage 22. As shown in FIG. 11, the inner valve 19 has a seat portion 72 at the bottom, which seats on a valve seat 70 of the outer valve 18 to interrupt fuel flow between the passage 22 and the bore 36. The upper movement of the inner valve 19 is limited by the stopper 71. The exciting means has a coil 20 mounted on a solenoid housing 63, a stator 60 fixedly mounted on a case 62 through the solenoid housing 63, a movable core 61 fixedly mounted on the outer valve 18 and attracted against the stator 60 upon energization, and a compressive coil spring 21 for biasing the outer valve 18 toward a side opposite to the attracting side.

Figure 2:
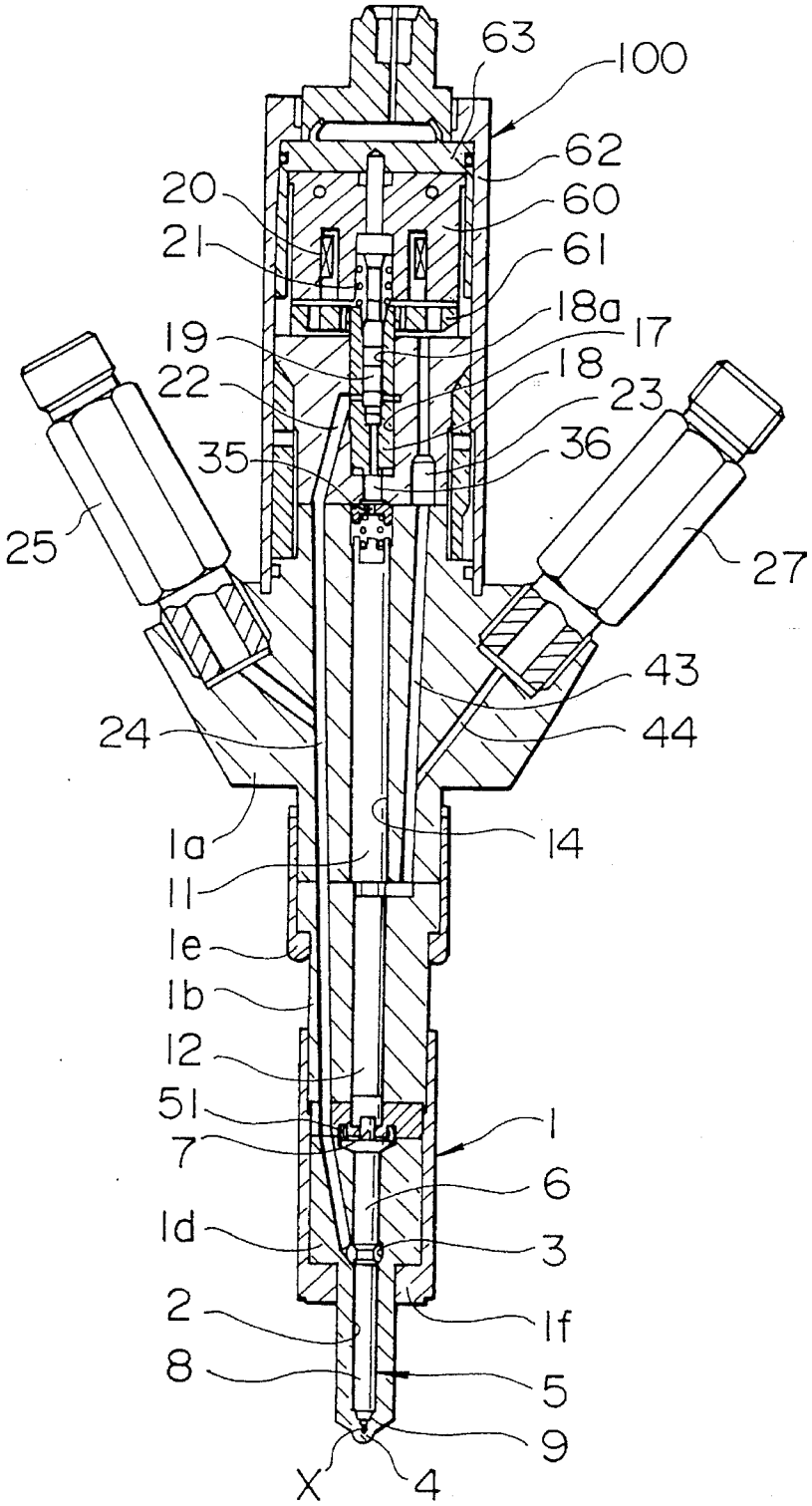
FIG. 2 is a cross-sectional view showing the fuel injection apparatus for the diesel engine illustrated in FIG. 1, the cross-sectional view being cut in a cross-sectional surface different from that shown in FIG. 1.

When the coil 20 is deenergized, the outer valve 18 is located at a lower position by a biasing force of the compressive coil spring 21. In case high-pressure fuel is supplied from passage 22 into the outer valve 18 through radial passages of the outer valve 18, the inner valve 19 is pushed upwardly by the high fuel pressure and is stopped in its upward movement by stopper 71, as shown in FIG. 11. Passage 22 and the first pressure control chamber 15 communicate with each other through the passage 36. Further, when the coil 20 is energized, the outer valve 18 is moved upwardly. At this time, the seat portion 72 of the inner valve 11 seats on the valve seat 70 of the outer valve 18, and the fuel flow between the passage 22 and the bore 36 is interrupted. On the other hand, the first pressure control chamber 15 and the drain passage 23 communicate with each other via a passage 73. In this connection, as shown in FIG. 2, fuel within a drain passage 23 can be drawn to a drain tank (not shown) through passages 43 and 44 and an outlet 27.

The detailed description of the three-way electromagnetic valve 16 is referred to in U.S. Pat. Nos. 5,125,575 and 5,156,132, the relevant content of which is incorporated herein by reference.

The casing 1 is formed therein with a fuel supply passage 24. The fuel supply passage 24 has one end thereof which is connected to the fuel reservoir chamber 3 and the other end which is connected to the passage 22 in the three-way electromagnetic valve 16. An accumulator piping 26 accumulates high-pressure fuel which is supplied from a high-pressure supply pump (not shown). The accumulator piping 26 supplies the high-pressure fuel to the injectors 100 arranged respectively for cylinders, through an inlet 25. Signals from a cylinder judgment sensor, a cam-angle sensor, an accelerator-opening sensor and the like are inputted to a controller 28 so that the controller 28 controls the three-way electromagnetic valve 16 at predetermined fuel injection timing.

Operation will next be described.

The high-pressure fuel in the accumulator piping 26 is supplied into the injector 100 through the inlet 25. The fuel is supplied to the fuel reservoir chamber 3 through the fuel supply passage 24, and is supplied to the three-way electromagnetic valve 16.

At this time, in a case where the three-way electromagnetic valve 16 is deenergized, the outer valve 18 is seated by the compressive coil spring 21. The fuel supplied to the three-way electromagnetic valve 16 moves the inner valve 19 upwardly in the figures. The seat portion 72 is apart from the valve seat 70 and fuel flows into the passage 36 through the radial passages as shown in FIG. 11.

Figure 12:
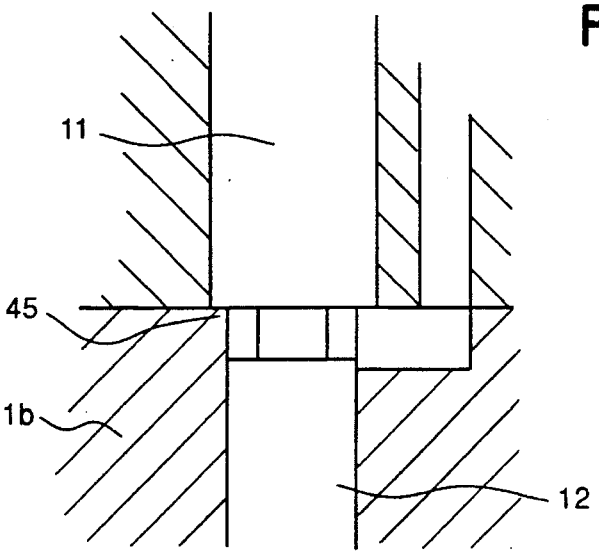
FIG. 12 is an enlarged cross-sectional view showing stopper 45 in FIG. 1.

The fuel flowing into the passage 36 flows into the first pressure control chamber 15 through the restriction passage 35. Under a condition in which predetermined time elapses, the first pressure control chamber 15 is filled with the high-pressure fuel. At this time, the first pressure control chamber 15, the second pressure control chamber 50 and the fuel reservoir chamber 3 are high in pressure. The first piston 11 is abutted against a stopper 45. The stopper 45 is formed as a circumferential shoulder on the upper end surface of the spacer 1*b*, as shown in FIG. 12. The lower movement of the piston 11 is limited by the stopper 45. At this time, the second piston 12 is abutted against the first piston 11. The nozzle needle 5 is seated upon the seat x by a difference between a pressure receiving area within the second control chamber and a pressure receiving area at the fuel reservoir chamber 3 and the setting force of the annular spring element 51.

When the three-way electromagnetic valve 16 is excited or energized, the outer valve 18 is attracted upwardly in the figures. At this time, the seat portions 72 seats on the valve seat 70, and the fuel flow between the passage 22 and the bore 36 is interrupted. Therefore, the bore 36 communicates with the drain 23 through passage 73, the fuel within the first pressure control chamber 15 escapes toward the low pressure side through the passage 36 and the drain passage 23. At this time, however, the first pressure control chamber 15 is restricted in outflow of the fuel by the restriction passage 35. Accordingly, the pressure within the first pressure control chamber 15 is not at once reduced, but is maintained to high pressure during a predetermined period of time. Thus, the first piston 11 is retained to a condition abutted against the stopper 45. At this time, the second piston 12 is located while being abutted against the first piston 11. The nozzle needle 5 rises or is moved upwardly by the amount of pre-lift indicated in FIG. 3, by a difference between pressure (low pressure) received by the pressure receiving area of the second pressure control chamber 56 and pressure (high pressure) received by the pressure receiving area at the fuel reservoir chamber 3 and the setting pressure of the annular spring element 51.

Subsequently, when the pressure within the first pressure control chamber 15 is reduced to a level so bearing as to raise the first piston 11 and the second piston 12, the first piston 11 and the second piston 12 are brought to a full-lift condition.

Subsequently, when the three-way electromagnetic valve 16 is deenergized, the high-pressure fuel is supplied to the fist pressure control chamber 15 and the second pressure control chamber 50 through the three-way electromagnetic valve 16 and the passage 36. Then, the first piston 11 receives the pressure within the first pressure control chamber 15 and is instantaneously moved downwardly in the figures. In keeping therewith, the second piston 12 and the nozzle needle 5 are moved downwardly. Thus, injection has soon come to an end.

Figure 6:
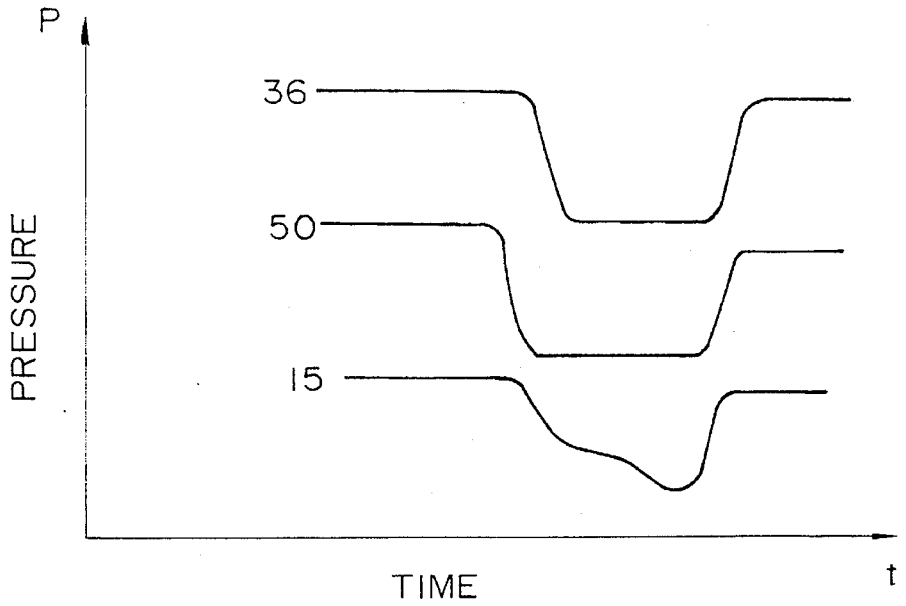
FIG. 6 is a time chart showing pressure changing characteristic of the above-described embodiment of the invention.
Figure 7:
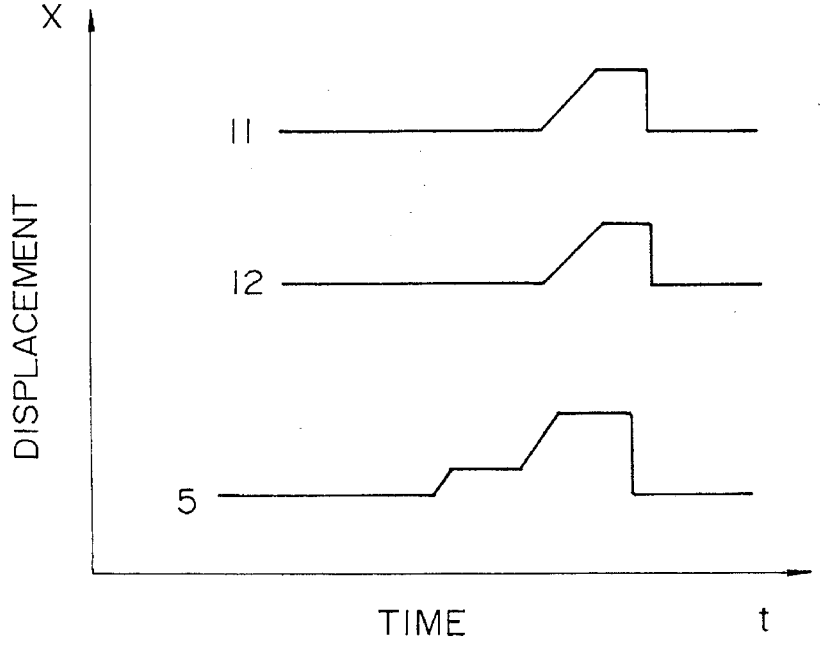
FIG. 7 is a time chart showing displacement characteristic of the above-mentioned embodiment of the invention.
Figure 8:
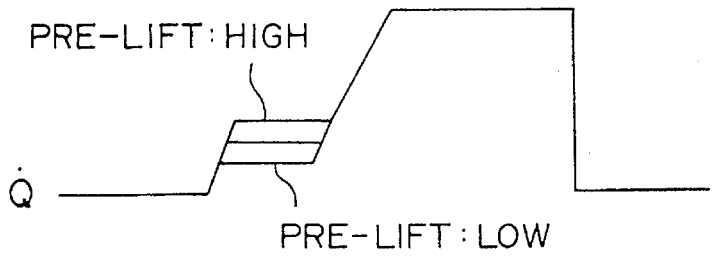
FIG. 8 is a view for describing the injection characteristic of the above-described embodiment of the invention.
Figure 9:
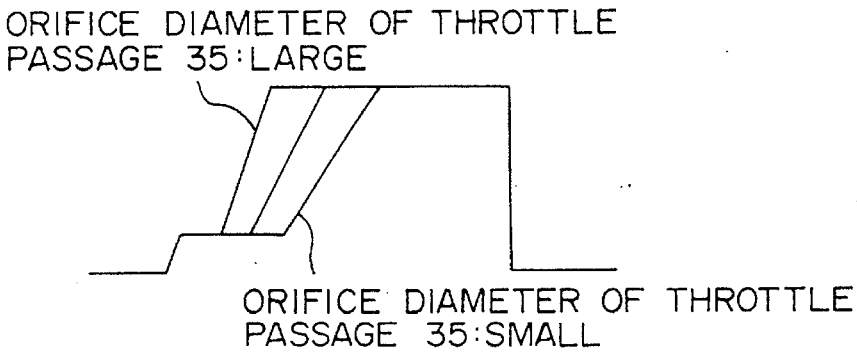
FIG. 9 is a view for describing the injection characteristic of the above-described embodiment of the invention.
Figure 10:
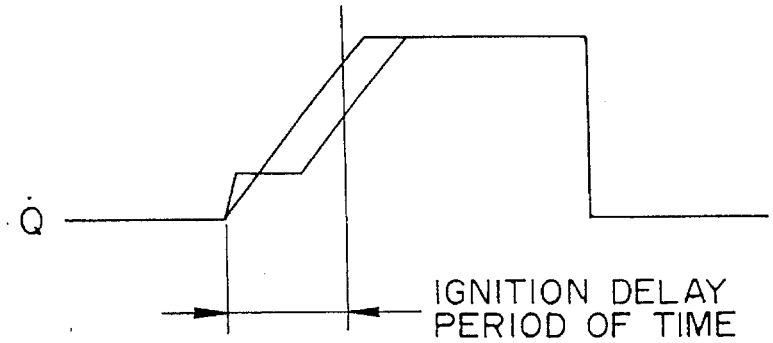
FIG. 10 is a view for describing the injection characteristic of the above-described embodiment of the invention.

In connection with the above, FIG. 6 is a time chart showing pressure variation or change of the passage 36, the second pressure control chamber 50 and the first pressure control chamber 15 due to the above-described operation. FIG. 7 is a time chart showing displacement of each of the first piston 11, the second piston 12 and the nozzle needle 5 in the above-mentioned operation. As shown in FIG. 8, an amount of pre-lift can be adjusted by axial length of each of the distance piece 1*c* and the spacer 1*b* illustrated in FIG. 4. Further, as shown in FIG. 9, by regulation or adjustment of the restriction diameter of the restriction passage 35, it is possible to control an inclination of full-lift ascending of the nozzle needle 5. Moreover, as shown in FIG. 10, since it is possible to reduce the amount of injection during a period of ignition lag or delay time as compared with the conventional delta-type injection, it is possible to prevent dash combustion from occurring to reduce nitrogen oxides.

Figure 4:
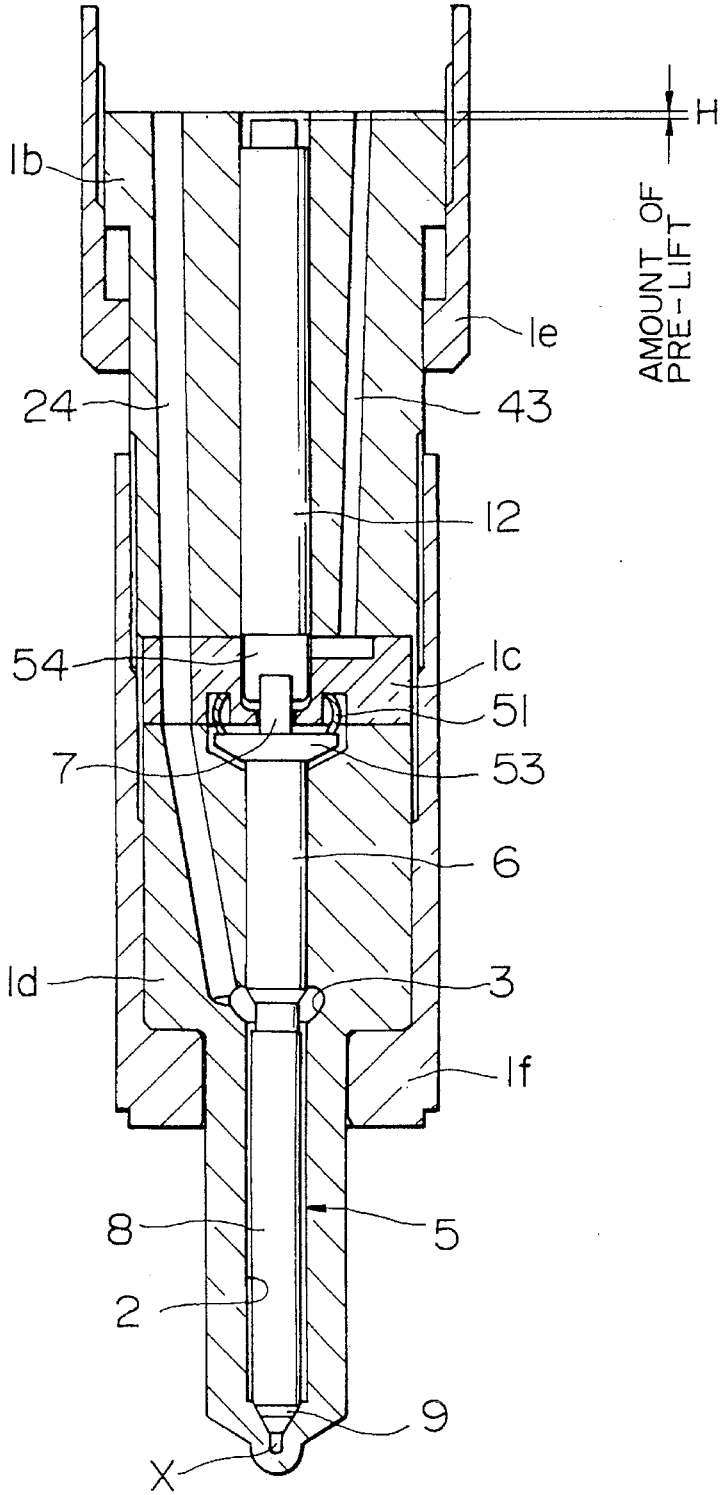
FIG. 4 is a cross-sectional view showing the fuel injection apparatus for the diesel engine illustrated in FIG. 1, describing operation of setting the amount of pre-lift prior to completion of assembling.

With the arrangement of the embodiment, as shown in FIG. 4, upon assembling, the second piston 12 is abutted against the nozzle needle 5, and the amount of pre-lift H is set by a step between the second piston 12 and the spacer 1*b*. Setting of the amount of pre-lift H of the nozzle needle 5 can be managed only by the step H between the spacer 1*b* and the top of the second piston 12 illustrated in FIG. 4. Conventionally, the longitudinal size of the lower element has controlled or governed the amount of pre-lift. In the present embodiment, however, dimensional management of the lower element 1*a* is dispensed with because the amount of pre-lift is decided. Accordingly, setting of the amount of pre-lift is facilitated. Furthermore, only rearrangement of the various parts illustrated in FIG. 4 into a body by the retaining ring 1*e* makes it possible to perform operation of adjustment of the amount of pre-lift and operation of inspection and maintenance. Thus, there is provided an advantage that serviceability is improved.

Since elastic deformation of the annular spring element 51 is relatively low as compared with that of the compressive coil spring upon assembling of the annular spring element 51 in the aforesaid embodiment, there is also provided an advantage that the amount of pre-lift can always be maintained properly or adequately.

As described above, the fuel injection apparatus for the diesel engine, according to the invention, enables the boot-type injection and decides the amount of pre-lift of the nozzle needle which decides the injection rate, by the intermediate portion of the group of parts which are moved together with the nozzle needle. Accordingly, there are produced advantages that the operation of setting of the amount of pre-lift is facilitated, and operability upon maintenance and inspection is also improved. Moreover, there are produced the following advantages. That is, when the amount of pre-lift of the nozzle needle is decided, management of the longitudinal dimension of the plurality of parts which cooperate to form the injector is facilitated. Furthermore, an estimate of the longitudinal deformation of the parts due to the hydraulic pressure is facilitated.

What is claimed is:

1. An accumulator fuel injection apparatus comprising:

a casing element formed therein with a guide bore;

a nozzle element reciprocally guided in said guide bore;

a first pressure control chamber against which one end side of said nozzle element faces;

an injection bore;

a seat provided at another end side of said nozzle element for opening and closing said injection bore;

accumulator piping in which high-pressure fluid is accumulated;

a low-pressure chamber; and a control valve, wherein said first pressure control chamber communicates with said accumulator piping, and said low-pressure chamber in switching by said control valve, to reciprocate said nozzle element, to thereby control said injection bore in opening and closing, and wherein said nozzle element is divided into a first piston having said one end side of said nozzle element and a second piston having said other end side of the nozzle element, said accumulator fuel injection apparatus further comprising:

a stopper for setting a maximum-movement position of said first piston toward said second nozzle;

a second pressure control chamber communicating in switching with said accumulator piping and said low-pressure chamber in synchronism with said first pressure control chamber, by said control valve, and for forming a predetermined interval through which said first piston and said second piston are spaced away from each other, under a condition that said first piston is arranged at said maximum movement position; and delay means for delaying reduction of the pressure within said first pressure control chamber due to the fact that fluid flows into said low-pressure chamber from said first pressure control chamber upon communication of said first pressure control chamber and said low-pressure chamber with each other.

2. An accumulator fuel injection apparatus, according to claim 1, wherein said delay means is a one-way orifice.

3. An accumulator fuel injection apparatus comprising:

accumulator piping accumulating therein high-pressure fuel;

a first piston reciprocally guided in a guide bore formed in a lower element and having one end side thereof which faces a first pressure control chamber;

a stopper for setting a maximum movement position toward the other end side of said first piston;

a second piston reciprocally guided in a guide bore formed in a spacer, and having one end side thereof abutted against the other end of said first piston and the other end side facing a second pressure control chamber which communicates in switching with said accumulator piping and a low pressure chamber in synchronism with said first pressure control chamber, by a control valve;

a nozzle needle whose one end side faces said second pressure control chamber, said nozzle needle having a seat at the other end side of said nozzle needle;

a valve casing having a guide bore for reciprocally guiding said nozzle needle, a valve seat abutted against the seat of said nozzle needle, and an injection bore;

delay means for delaying reduction of pressure within said first pressure control chamber due to the fact that fluid flows into a low-pressure chamber from said first pressure control chamber upon communication of said first pressure control chamber and said low-pressure chamber with each other; and biasing means for spacing said second piston and said nozzle needle away from each other so as to form a predetermined gap between the other end side of said second piston and said one end side of said nozzle needle under a condition that said first piston is arranged at said maximum movement position.

4. An accumulator fuel injection apparatus according to claim 3, further comprising pre-lift-amount deciding means for connecting said second piston and said nozzle needle to each other so as to be variable in axial distance within a predetermined range, to decide an amount of pre-lift of said nozzle needle.

5. An accumulator fuel injection apparatus according to claim 4, wherein said pre-lift-amount deciding means is such that a connecting portion of said nozzle needle is slidably fitted in a cylinder portion formed in said piston.

* * * * *